United States Patent [19]

Geib, Sr. et al.

[11] Patent Number: 4,523,081

[45] Date of Patent: Jun. 11, 1985

[54] FORCED AIR BASEBOARD HEATER AND AIR DUCT DIFFUSER

[75] Inventors: Henry T. Geib, Sr., Ixonia; Wayne C. Griffith, Hartland, both of Wis.

[73] Assignee: M. P. Metal Products, Inc., Ixonia, Wis.

[21] Appl. No.: 453,482

[22] Filed: Dec. 27, 1982

[51] Int. Cl.[3] ..... F24F 5/00; F24H 3/04; F24H 9/02; H05B 3/40

[52] U.S. Cl. ..... 219/370; 165/123; 219/367; 219/374

[58] Field of Search ..... 219/365, 366, 367, 368, 219/369, 370, 371, 374; 165/122, 123, 126

[56] References Cited

U.S. PATENT DOCUMENTS

| | | | |
|---|---|---|---|
| 2,058,252 | 10/1936 | Parsons . | |
| 2,522,860 | 9/1950 | Conaway . | |
| 2,568,278 | 9/1951 | Favot . | |
| 2,839,659 | 6/1958 | Cotts et al. | 165/64 |
| 2,847,545 | 8/1958 | Alexander | 219/374 |
| 2,988,626 | 6/1961 | Buttner | 219/369 |
| 3,025,382 | 3/1962 | Eisele . | |
| 3,061,706 | 10/1962 | Lundbom | 219/374 |
| 3,265,859 | 8/1966 | Castello et al. | 219/367 |
| 3,267,255 | 8/1966 | Schulz | 165/122 |
| 3,440,400 | 4/1969 | Cotts . | |
| 3,473,006 | 10/1969 | Barbier | 219/364 |
| 3,512,578 | 5/1970 | Honmann | 165/123 |
| 3,517,163 | 6/1970 | Leiner | 219/364 |
| 3,622,752 | 11/1971 | Brasch . | |
| 3,631,525 | 12/1972 | Brasch . | |
| 3,768,549 | 10/1973 | Goodie | 219/367 |
| 3,794,810 | 2/1974 | Brasch . | |
| 3,912,903 | 10/1975 | Northrup . | |
| 3,993,244 | 11/1976 | Taylor | 219/365 |
| 4,126,268 | 11/1978 | Vitale | 165/122 |
| 4,149,065 | 4/1979 | Goff et al. | 219/368 |
| 4,384,189 | 5/1983 | Dahan | 219/370 |

FOREIGN PATENT DOCUMENTS

| | | | |
|---|---|---|---|
| 2233725 | 1/1974 | Fed. Rep. of Germany | 165/123 |
| 599956 | 3/1948 | United Kingdom | 219/374 |

*Primary Examiner*—Roy N. Envall, Jr.
*Assistant Examiner*—Geoffrey S. Evans

[57] ABSTRACT

An electric heater adapted to be used as a space heater or to be mounted over the discharge end of a hot air duct to diffuse air flowing into a room from the hot air duct and to heat the air in the room. The electric heater includes a housing adapted to be positioned over the discharge end of a hot air duct, the housing including an air outlet opening, and an elongated chamber therein. An elongated heating element is housed in an elongated chamber defined by the housing. An air conduit is also located in the housing and extends parallel to the elongated heating element. Air outlet openings are provided along the length of the air conduit, and a centrifugal fan blows air into the air conduit and this air is forced through the air outlet openings toward the elongated heating element and such that air is directed toward the heating element along a substantial portion of the length of the heating element.

1 Claim, 4 Drawing Figures

FORCED AIR BASEBOARD HEATER AND AIR DUCT DIFFUSER

FIELD OF THE INVENTION

The invention relates to apparatus for providing an auxiliary heat source for a room and more particularly to electrical heaters for use in providing secondary heat sources.

BACKGROUND OF THE INVENTION

Due to the increasing costs associated with heating homes and other buildings, efforts have been made to develop a practical and inexpensive means for providing more heat in one room of a house or other building than in the other rooms of the house. Heating only those rooms of a home where additional heat is wanted permits the remainder of the home to be heated less, and the costs of heating the home are reduced. Prior art auxiliary heaters include conventional electrical space heaters. Many common space heaters are impractical because they are inefficient and because they may not provide sufficient heat.

Other prior art heaters for these applications include auxiliary electric heating device adapted to be mounted in a section of the heating ducts of a hot air or forced air heating system. These electrical heating means provide for increasing the temperature of the air flowing through these heating ducts and thereby increasing the temperature in a selected room or rooms of a house. An example of such an auxiliary heater is illustrated in the Eisele U.S. Pat. No. 3,025,382, issued Mar. 13, 1962.

One of the features of these prior art devices is that installation normally requires removal of a portion of the heating duct and then installation of the auxiliary heater into the heating duct. Such installation will commonly require the expertise of a mechanical contractor. These auxiliary heating devices also include electrical heating elements and electrically operated control systems, and normally an electrical contractor must be employed to wire the electrical heating elements and to provide electrical connections for the various heat control or thermostat systems.

Attention is also directed to Cotts U.S. Pat. No. 2,839,659 illustrating a heat diffuser adapted to be used as a means for diffusing air coming out of a hot air heat duct, the heat diffuser also including an electrical heating element to further heat the air coming through the air duct.

The prior art also includes electrical baseboard heaters of the type including elongated electric heating elements and functioning by means of convection to heat the air in a room. More specifically, such heaters include means for supporting an elongated electrical heating element including a plurality of heat transfer fins or vanes. Air moves by means of convection through the heat transfer vanes. These heating devices may also require costly installation and have the further disadvantage of being economically inefficient. They also often fail to provide effective circulation of the heated air in the room.

SUMMARY OF THE INVENTION

The present invention provides an improved and more efficient means for providing auxiliary heat in the room of a house or other building and means for heating such a room independently of the heat being supplied to the rest of the house. The heating apparatus of the invention also provides an efficient heat source functional to cause improved circulation of the heated air in a room, and it may be used either as a portable space heater or it may be positioned over the discharge outlet of a hot air duct to function as both an air diffuser and as an auxiliary heater. When the auxiliary heater embodying the invention is used in this second application, it further has the advantage of being easily installed and wired such that the services of a mechanical contractor and electrical contractor can be avoided, thereby reducing the cost of its installation.

More particularly, the invention includes an electric heater adapted to be mounted over the discharge end of a hot air duct to diffuse air flowing into a room from the hot air duct and to further heat the air in the room. The electric heater includes a housing adapted to be positioned over the discharge end of the hot air duct, the housing including an air outlet opening, and an elongated chamber therein. An elongated heating element is housed in the chamber and extends substantially along the length of the chamber. Means are also provided for forcing air across the elongated heating element along a substantial portion of the length of the heating element, the means for forcing air including means defining an air conduit extending along the length of the elongated heating element. Air outlet means are provided along the length of the air conduit whereby air flowing through the air conduit is discharged toward the elongated heating element. Means are also provided for forcing air through the air conduit and through the air outlet means toward the elongated heating element.

The invention also includes an electric heater comprising a housing including an air outlet opening, and an elongated chamber therein, and an elongated heating element housed in the elongated chamber and extending substantially along the length of the chamber. Means are also provided for forcing air across the elongated heating element along a substantial portion of the length of the heating element, this means including an air conduit extending along the length of the elongated heating element. Air outlet means are provided along the length of the air conduit whereby air flowing through the air conduit is discharged toward the elongated heating element. Means are also provided for forcing air through the air conduit and through the air outlet means toward the elongated heating element.

In a preferred form of the invention the air conduit comprises an elongated tube positioned in the housing, the elongated tube being mounted in parallel spaced relation with respect to the heating element, and the tube having a length substantially the same length as that of the elongated heating element.

In a preferred form of the invention the air outlet comprises an elongated opening in the conduit adjacent the elongated heating element whereby air forced into the elongated conduit is directed through the elongated opening in a direction transverse to the longitudinal axis of the elongated conduit and toward the elongated heating element.

In one embodiment of the invention the means for forcing air into the elongated conduit includes a centrifugal fan, and an electric motor is drivingly connected to the centrifugal fan.

One of the particular advantages of the invention is that when the auxiliary heating device embodying the invention is used an an air diffuser for a hot air duct, it has the advantage of being easily installed by the consumer without requiring cutting of duct work and without wiring of heating elements and controls. The heating apparatus embodying the invention is constructed such that it can be plugged into a conventional 110 volt outlet and can be mounted in place by merely removing the existing hot air diffuser from the outlet of the hot air duct and by substituting the auxiliary heating apparatus of the invention. The apparatus also includes a self-contained thermostatic unit and thereby eliminates the requirement for a thermostat wired into the house wiring or the heating control means of the building.

Another advantage of the apparatus embodying the invention is that it provides a more efficient and compact heating unit than can be provided by conventional convection baseboard heating devices. A conventional electric baseboard heater has a capacity of approximately 250 watts per linear foot along the baseboard whereas a heater embodying the invention can have a capacity of at least 750 watts per linear foot.

Various other features and advantages of the invention will be apparent by reference to the following description of a preferred embodiment, from the drawings, and from the claims.

Figure 1:
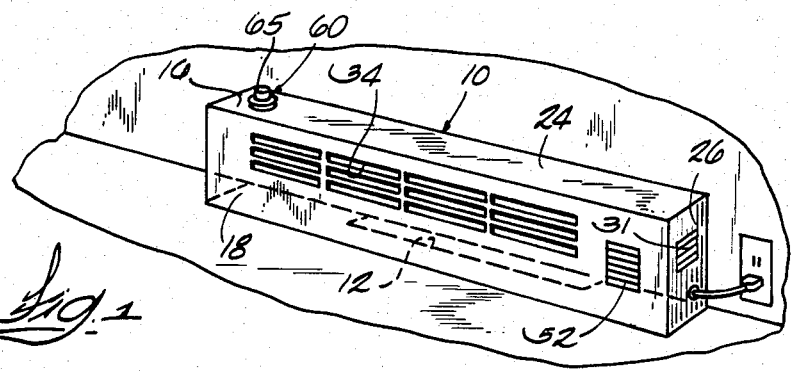
FIG. 1 is a perspective view of an electric heater embodying the present invention.

Before describing a preferred embodiment in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an auxiliary heating device 10 embodying the present invention, the auxiliary heating device 10 being adapted to be used either as a space heater or to be placed over the disharge outlet 12 of a hot air duct 14 of a conventional forced air heating system in a home or other building to function as a combination of a hot air diffuser and an auxiliary heater. For purposes of illustraton, the auxiliary heater is shown as also functioning as an air diffuser for a hot air duct of a conventional heating system, but it should be understood that it can also be used as a portable heater. The auxiliary heating device 10 is shown as including a generally elongated housing 16 having a size similar to that of a conventional baseboard diffuser of the type intended to distribute air being discharged into a room by an air duct. It is preferred that the auxiliary heater 10 have a size and shape the same as that of conventional hot air diffusers so that the hot air diffusers can be removed and replaced with the auxiliary heater 10.

In a preferred form of the invention, the housing 16 includes a front wall 18, a back wall 20, a bottom wall 22 and a top wall 24. The housing 16 also includes end walls 26. The housing 16, which is comprised of sheet metal, defines an elongated rectangular chamber or cavity 28 adapted to house an elongated heating element 30. The bottom wall 22 includes an opening 32 of generally rectangular configuration and of a size and shape intended to register with the discharge outlet 12 of the hot air duct 14 of a conventional forced air heating system. While in the illustrated embodiment, the housing 16 is shown as including a bottom wall 22 and a back wall 20, in other embodiments of the invention, the bottom and back walls 20 and 22, could be deleted. The front wall includes a discharge outlet means whereby air may be discharged from the housing 16. In the illustrated arrangement, the discharge outlet means is comprised of a plurality of discharge openings 34 located adjacent the upper edge of the front wall 18 and extending along a substantial portion of the length of the housing 16. In other arrangements the discharge outlet could also be in the top wall or in both the top wall and front wall.

The housing also includes an interior wall 23 at one end of the housing and for forming a chamber 25 at the end of the housing. The housing 16 also includes a second interior wall 27 at an opposite end of the housing so as to define a second chamber 29 at that end. Both end walls 26 include a plurality of elongated narrow slots or openings 31 so as to vent the chambers 25 and 29.

Means are also provided for forming an elongated heating element extending along a substantial portion of the length of the housing 16. While various heating element means could be provided for forming a heat source, in the illustrated arrangement, the means for forming a heat source comprises an elongated electric heating element 30 supported in the chamber 28 defined by the housing and extending along a substantial portion of its length. While the heating element 30 is illustrated as being linear, in other arrangements it could have other configurations. In a preferred form of the invention, the heating element 30 also includes a plurality of thin planar metal vanes 38 spaced apart along its length and adapted to transfer heat from the heating element 30 to the air moving through the heater housing 16.

In operation of the auxiliary heating device 10, when hot air is being forced through the heat duct 14 and into the housing 16 of the auxiliary heater, that air will flow past the elongated heating element 30 and will be further heated, and the air flowing into that room having the auxiliary heater 10 will be heated more than the other rooms of the house.

In a preferred form of the invention, the heating element 30 is constructed such that it can be plugged into any conventional 110 v. outlet. This facilitates replacement of an existing air diffuser with an auxiliary heater embodying the invention and without the expense of wiring the heater to the house internal wiring.

A second means is also provided for causing airflow into the housing 16 and past the heating element 30. This means for causing airflow into the housing 16 includes means for providing a substantially uniform airflow across the heating element 30 and past the vanes 38 of the heating element, this airflow being substantially equal along the entire length of the elongated heating element 30. This means for causing airflow includes an elongated air conduit 40. In the illustrated construction, the elongated air conduit 40 has a length substantially the same as that of the elongated heating element 30 and is mounted in the housing 16 so as to extend in parallel spaced relation to the heating element.

In the particular arrangement illustrated, the elongated air conduit 40 comprises a relatively narrow tube mounted in the housing 16 adjacent a lower portion of the front wall 18 such that the elongated air conduit is located generally beneath the elongated heat element 30 and extends substantially along its entire length. The elongated air conduit 40 includes an inlet opening 42 at one end and it is closed at its opposite end by an end wall 44.

The elongated air conduit 40 also includes an air discharge outlet means extending along its entire length. In the illustrated construction, the air discharge outlet means comprises a plurality of apertures 46 spaced along the length of the elongated air conduit 40 and arranged such that air flowing through the elongated air conduit is directed upwardly and toward the elongated heating element. The air is heated by the vanes and the heating element 30 and is then discharged through the openings 34 in the front wall 18 of the housing.

While in the illustrated embodiment the means for providing airflow toward the elongated heating element 30 is comprised of a number of apertures spaced apart along the length of the elongated air channel 40, in other embodiments of the invention the elongated air discharge means could comprise a narrow slot in an upper portion of the air channel 40 and extending along the length of the elongated air channel, the narrow slot being located below the elongated heating element and arranged such that air flowing through the elongated air channel will be directed upwardly through the slot and past the elongated heating element such that heat from the vanes can be transferred to the air flowing past the heat element.

Means are also provided for causing airflow into the inlet end 42 of the elongated air channel 40. While various means could be provided, in the illustrated arrangement, this means includes a centrifugal fan 50 supported in the housing 16 adjacent the inlet end 42 of the elongated air channel 40, and an air inlet 52 (FIG. 1) is provided in the front wall 18 of the housing 16. In the particular embodiment of the invention illustrated, the air inlet 52 is comprised of a plurality of narrow slots in the front wall 18. In operation, the centrifugal fan 50 is driven by an electric motor and causes air to be drawn through the air inlet 52 in the front wall 18 of the housing and to be forced into the elongated air channel 40 in the direction of the closed end 44 of the elongated air channel. An example of a suitable centrifugal fan is a 2½ inch centrifugal fan manufactured by L. R. Mfg. Co., Torrington, Conn.

While the means for causing airflow into the inlet end 42 of the elongated air channel 40 is illustrated as comprising a centrifugal fan 50, in other embodiments if could be constructed in other ways.

Means are also provided for controlling the operation of the electrical heating element 30 and the fan to provide for selective operation of these elements. This controlling means includes means for controlling operation of the fan 50 and the heating element 30 as a function of the air temperature in the room being heated and by means for causing current flow to the heating element 30 to be interrupted in the event the temperature of the heater 10 exceeds a predetermined value. This controlling means includes a thermostat 62 and a high temperature cut-out means 64. These control devices 62 and 64 illustrated in the drawings are commercially available and will not be described in detail. In one embodiment of the invention, the thermostat 62 can be a conventional Norstat Type "A" thermostat Model 81-325. The high temperature cut-out device 64 can comprise a Therm-O-Disc Type 10H11 having a cut-out temperature of approximately 250°, manufactured by Therm-O-Disc Inc., Mansfield, Ohio.

Figure 4:
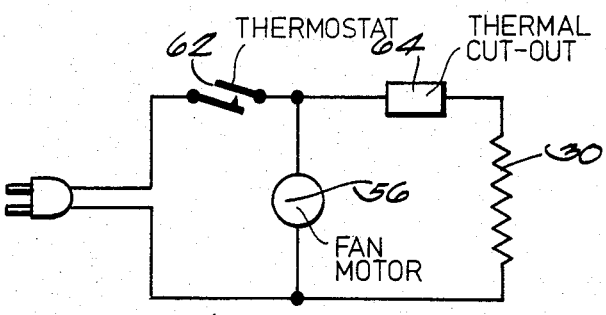
FIG. 4 is a schematic view of the electrical components of the air diffuser illustrated in FIG. 1.

As illustrated in FIG. 4, the elongated heating element 30 and the fan motor 56 are wired in parallel. The thermostat 62 is operably connected to both the electrical heating element 30 and the fan motor 56. The high temperature cut-out device 64 functions to interrupt electrical current to the heating element 30 when the temperature of that heating element exceeds a predetermined value. The high temperature cut-out device 64 does not control the fan motor 56. Accordingly, the high temperature cut-out device 64 may interrupt current flow to the electrical heating element 30 while the fan 50 will continue to function and cause airflow across the heating element 30. The thermostat 60 includes a rotatable control knob 65 to permit the operator to select a suitable temperature range of operation of the heater 10.

In the illustrated construction the housing 16 also includes a curved deflector 67 positioned above the elongated heating element and adapted to redirect the air flowing upwardly past the heating element 30 through the opening 34 in the front wall 18 of the housing and generally horizontally out into the room being heated.

Figure 2:
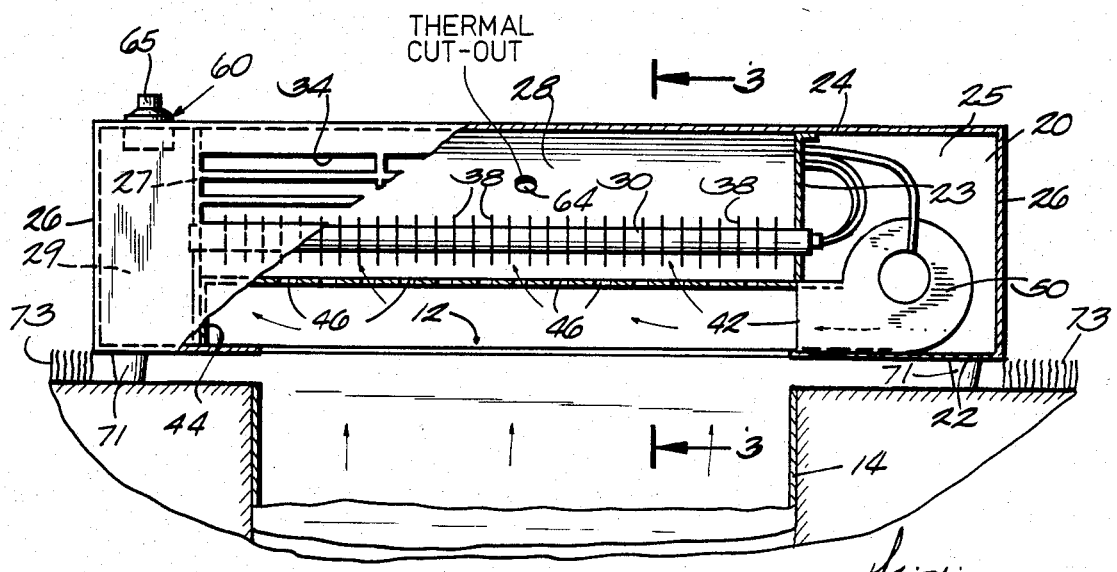
FIG. 2 is a cross-section elevation view of the auxiliary electric heater illustrated in FIG. 1.
Figure 3:
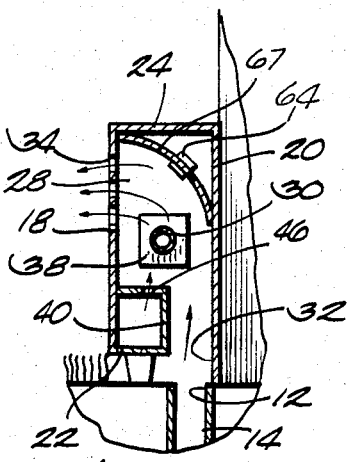
FIG. 3 is a cross-section view taken along line 3—3 in FIG. 2.

In the illustrated construction the auxiliary heater 10 also includes a plurality of relatively short legs 71 adapted to support the housing 16 off of the floor. When the auxiliary heater 10 is employed as a space heater, the legs 71 support the housing 16 in spaced relation from the floor to permit airflow through the opening 32 into the housing. In a preferred form of the invention the legs 71 will have a length substantially equal to the thickness of a conventional household carpet, shown for purposes of example in FIG. 2 by reference numeral 73. When the auxiliary heater 10 is employed in place of an air diffuser, as illustrated in the drawings, the bottom wall 22 of the housing 16 will be generally flush with the surface of the carpet 73.

Various features of the invention are set forth in the following claims:

We claim:

1. A portable electric heater adapted to be mounted over the discharge end of a hot air duct to diffuse air flowing into a room from the hot air duct and to selectively heat the air in the room, the electric heater comprising a housing including a top wall, a bottom and a front wall and adapted to be positioned over the discharge end of the hot air duct, the housing including an elongated air inlet in said bottom, said air inlet being positionable over the discharge end of the hot air duct whereby air from the discharge end of the hot air duct can flow into the housing, and the housing including an air outlet opening, and an elongated chamber therein, said chamber including opposite ends, an elongated electrical resistance heating element housed in said chamber and extending substantially along the length of said chamber, and means for forcing air upwardly across said elongated heating element along a substantial portion of the length of said heating element and toward said air outlet opening of said housing, said means for forcing air across said elongated heating element including means defining an air conduit positioned in said housing in parallel spaced relation from said elongated heating element and extending along the length of said elongated heating element, said air conduit comprising an elongated tube having opposite ends and said elongated tube being positioned adjacent said elongated air inlet of said housing, air outlet means along the length of said elongated tube, said air conduit air outlet means being adjacent said heating element and facing said elongated heating element whereby air flowing through said elongated tube is discharged toward said elongated heating element, and means for forcing air through said air conduit and through said air outlet means toward said elongated heating element, said means for forcing air through said elongated tube including a centrifugal fan contained in an end of said housing and connected to one of said ends of said elongated tube for forcing air into said elongated tube.

* * * * *